United States Patent [19]

Domingues

[11] Patent Number: 4,790,768

[45] Date of Patent: Dec. 13, 1988

[54] IMMERSIBLE ELECTRICAL COUPLING

[75] Inventor: Henri Domingues, Dourdan, France

[73] Assignee: Total Compagnie Francaise des Petroles, Paris, France

[21] Appl. No.: 51,564

[22] Filed: May 20, 1987

[30] Foreign Application Priority Data

May 20, 1986 [FR] France ..... 8607114

[51] Int. Cl.[4] ..... H01R 13/52

[52] U.S. Cl. ..... 439/320; 439/277

[58] Field of Search ..... 439/271-279, 439/281, 283, 587, 736, 604, 901, 905, 306, 320; 166/65.1, 88

[56] References Cited

U.S. PATENT DOCUMENTS

| | | | |
|---|---|---|---|
| 3,197,730 | 7/1965 | Hargett | 439/901 |
| 3,879,097 | 4/1975 | Oertle | 439/271 |
| 3,922,477 | 11/1925 | Glowacy | 439/271 |
| 3,963,297 | 6/1976 | Panek et al. | 339/94 |
| 3,980,369 | 8/1976 | Panek | 439/272 |
| 4,053,201 | 10/1977 | Grappe | 439/604 |
| 4,266,844 | 5/1981 | Chelminski | 439/736 |
| 4,295,701 | 10/1981 | Ginn | 439/271 |
| 4,588,247 | 5/1986 | Grappe et al. | 439/271 |

*Primary Examiner*—David Pirlot

*Attorney, Agent, or Firm*—Sughrue, Mion, Zinn, Macpeak & Seas

[57] ABSTRACT

An immersible electrical coupling includes a fixed connector (2) mounted on the wall (1) of a device, and a cable terminal (6) engaged with the connector. An outer molding of synthetic resin (33) surrounds tubular metal components (16, 12, 8, 10, 9) of the terminal, and a concentric inner molding 32 isolates the outer and inner sheaths (13, 17) of the cable (7). Within the terminal (6), the insulated conductors (19) which emerge from the end of the cable are spaced from one another, and traverse an insulating sealing plug (20) inserted in a watertight manner inside the tubular metal components (8, 9).

6 Claims, 1 Drawing Sheet

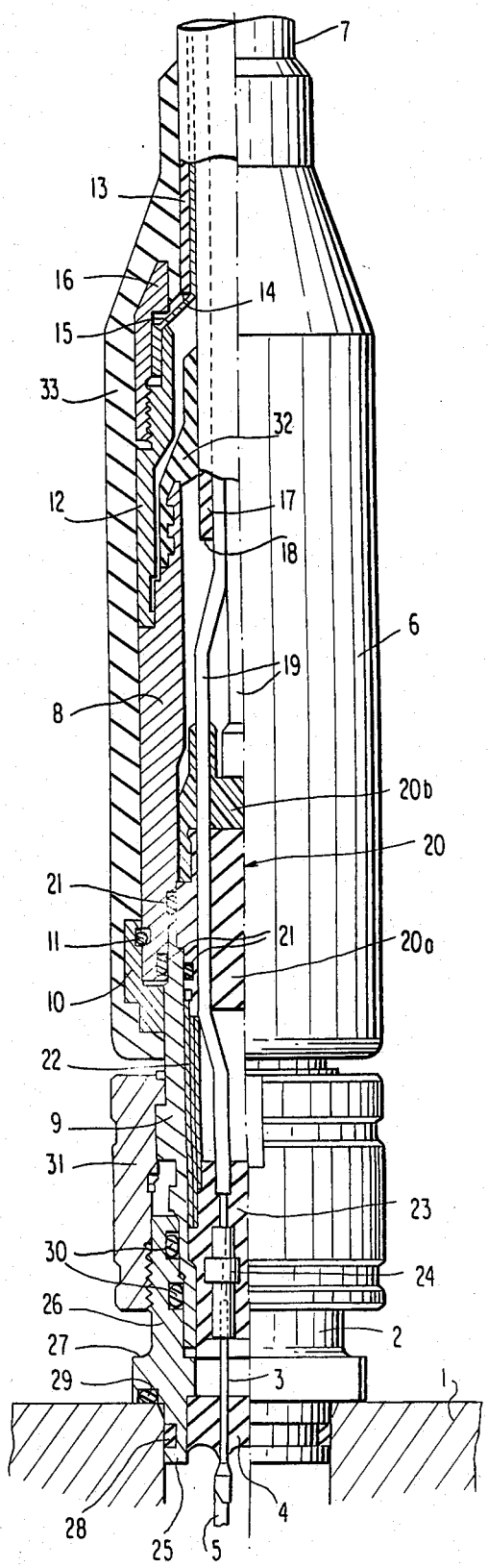
7
13
16
14
15
33
32
12
17
18
6
19
8
20b
20
21
11
21
20a
10
22
9
31
23
30
24
26
2
27
29
3
1
28
25
5
4

IMMERSIBLE ELECTRICAL COUPLING

BACKGROUND OF THE INVENTION

This invention concerns an electrical for connecting coupling an end or terminal fitting of an electrical cable to a fixed connector mounted on a housing wall of an electrical or electronic apparatus to enable the extended use of the connector coupling while immersed in water after having been assembled or joined on the surface.

The electrical cable includes, from the outside to the inside, at least one insulating outer sheath, a metallic armature, an inner insulating sheath, and individually insulated electrical conductors. The terminal fitting includes a tubular metal structure which accommodates the end of the cable and, on its front or mouth end, carries an insulating member in which contact sockets of the cable are embedded. Each socket is electrically connected to the end of one of the electrical conductors of the cable. To allow immersion, the outer sheath of the cable is terminated at a distance from the front end of the terminal fitting which is greater than the distance at which the inner sheath terminates, an outer elastomer molding is disposed between the outer sheath of the cable and the metal structure of the terminal fitting, and an inner elastomer molding is disposed between the inner sheath of the cable and terminal fitting tube. This arrangement substantially improves the behavior of the electrical connector in water, but it does not allow for very long immersion, for instance a period exceeding ten years, is currently desired.

SUMMARY OF THE INVENTION

One purpose of the invention is thus to increase the life span under water of an electrical coupling of the kind described above by spacing from one another the insulated electrical conductors of the cable in an area or space included between the end of the inner sheath and the contact-carrying insulating part, and by inserting into such space in a watertight manner an insulating plug sealingly traversed by each of the insulated electrical conductors.

The insertion of the insulating plug substantially improves the immersion behavior of the electrical coupling, and to benefit fully from this improvement, it is preferable to also alter the sealing means between the fixed connector and the housing wall that accommodates it, and between the fixed connector and the terminal fitting.

The fixed connector thus includes a metal part that forms a first tubular portion engaged in a wall opening, a second tubular portion which accommodates the inserted terminal fitting, and a mounting flange between the two tubular portions. O-ring joints or seals are provided on both the first tubular portion and on the mounting flange, in contact with the housing wall, and similar joints or seals are also provided between the fixed connector and the terminal fitting specifically on axially spaced sections of the second tubular portion having different internal diameters.

BRIEF DESCRIPTION OF THE DRAWINGS

The single figure shows an electrical coupling of the invention in elevation and partial axial section.

DETAILED DESCRIPTION OF THE PREFERRED EMBODIMENT

On wall 1 of a device (not fully shown) a fixed connector 2 is mounted inside which pins 3 are fastened. The pins are partially embedded in a watertight and insulating filler 4, and are connected electrically by links or couplings 5 to components inside the device.

The fixed connector 2 is configured to receive a terminal 6 of an electrical cable 7. The terminal 6 defines a tubular metal structure comprising an axial succession of parts that fit within one another, including a central tubular metal part 8, a front tubular metal part 9 connected mechanically to the latter by an overlap of neighboring ends and the application of an auxiliary sleeve 10 connected to the part 9 and axially retained on the part 8 by a "circlip" 11, and a rear tubular metal part 12 that partly overlaps part 8. These metal parts, as well as others which will be mentioned, are made from stainless steel, UA9F marine bronze, or the like.

The cable 7 includes an outer insulating sheath 13 which terminates at a transverse plane 14 close to the entrance of the cable in the terminal 6, a metal armature 15 which is radially extended within the terminal such that its end is held between the rear tubular metal part 12 and a metal fastening part 16 that acts as a nut and screws onto the part 12, an inner insulating sheath 17 which terminates at a transverse plane 18 within the terminal, and individually insulated electrical conductors 19.

The conductors 19 are spaced from one another inside the terminal 6 within a longitudinal space between the end of the inner sheath 17 and an insulating plug 20 formed around he conductors. The plug 20 includes a front portion **20*a* made of elastomer and a rear portion 20*b* made of a hard plastic material. It is sealed inside the metal structure by O-rings 21 inserted between the plug 20 and the metal parts 8 and 9, and between the latter two. A spacer part 22 separates the plug 20 from a contact-carrying insulating part 23 inside of which sockets 24 are embedded to accommodate pins 3 when the terminal 6 is coupled to the fixed connector 2. The sockets 24 are fastened to the ends of the conductors 19**.

The fixed connector 2 includes a first tubular metal portion 25 seated inside an opening in the wall 1, a second tubular metal portion 26 which accommodates internally the front end of the terminal 6, and a mounting flange 27 between the two tubular portions. O-rings 28 on the tubular portion 25 and 29 on the mounting flange 27 seal against the wall 1. Two O-rings 30 are disposed between the terminal 6 and the tubular portion 26 on sections with different internal diameters.

An outer sleeve 31 is rotatably mounted on the metal part 9 of the terminal 6, and is screwed onto the tubular portion 26 of the fixed connector 2 to mechanically fasten the terminal on the fixed connector.

An inner molding 32 made of elastomer is applied onto the inner sheath 17 and the metal part 8. An outer molding 33 made of an elastomer is applied over the cable insulating sheath 13, the metal parts 16, 12, 8 and 10, and against the exposed annulus of the metal part 9. The molding 33 thus covers all of the metal structure except for the front portion of the metal part 9 which is surrounded by the external coupling sleeve 31.

The tightness of the seal surrounding the electrical conductors can be tested during manufacturing by mounting the terminal 6 on the wall of a structure which is subjected to a strong vacuum, and injecting helium into the rear portion of the terminal.

What is claimed is:

1. In an immersible electrical coupling of the type comprising:

(a) a fixed connector (1) mounted on a wall (1) of an electrical apparatus housing;

(b) an electrical cable terminal (6) fitted over one end of an electrical cable (7) which includes, in a radially inward direction, an outer insulating sheath (13), a metal armature (15), an inner insulating sheath (17), and a plurality of individually insulated electrical conductors (19) adapted to be engaged at terminal ends thereof in the fixed connector;

(c) first and second units of complementary contact parts, the first unit (3) being mounted inside the fixed connector and the second unit (24) being mounted inside the cable terminal, each contact part of one unit being engaged with a complementary contact part of the other unit;

(d) a tubular metal structure (8, 9, 10, 12, 16) defined by the terminal (6) for retaining an end of the electrical cable in a watertight manner;

(e) a contact-carrying insulating part (23) mounted inside a front end of the metal structure, the contact parts of the second unit (24) being embedded in said insulated part and connected electrically to terminal ends of said electrical conductors (19);

(f) an end (14) of the outer insulating sheath (13) being disposed inside the cable terminal (6) at a greater distance from a front end of the terminal than an end (18) of the inner insulating sheath (17);

(g) an inner molding made of an elastomer material (32) applied between the inner sheath (17) of the cable and the metal structure (8); and (h) a concentric outer molding made of an elastomer material (33) surrounding the outer sheath (13) and a major portion of the tubular metal structure (16, 12, 8, 10, 9); the improvement consisting in that;

(i) a space is defined within the cable terminal (6) between the end of the inner insulating sheath (17) and the contact-carrying insulating part (23), the individually insulated electrical conductors (19) being spaced from one another within said space; and (j) an insulating plug (20) is disposed in said space, apart from said end of the inner insulating sheath and from said contact-carrying insulating part, said insulating plug surrounding each individually insulated electrical conductor in a watertight manner, and sealingly engaged inside the metal structure (8, 9).

2. An electrical coupling according to claim 1, wherein said insulating plug (20) includes a part made of elastomer material.

3. An electrical coupling according to claim 1, including O-ring joints (21) inserted between the insulating plug (20) and the metal structure (8, 9).

4. An electrical coupling according to claim 1, including a spacer (22) inserted between the plug (20) and the contact-carrying insulating part (23).

5. An electrical coupling according to claim 1, wherein the fixed connector (2) comprises a first tubular portion (25) engaged with the housing wall (1), a second tubular portion (26) accommodating an insertion end of the cable terminal (6), and a mounting flange (27) between the first and second tubular portions; and two O-ring joints (28, 29) to ensure water tightness are respectively disposed between the fixed connector and the wall, with one O-ring joint (28) arranged on the first tubular portion (25), and the other O-ring joint (29) on the mounting flange (27).

6. An electrical connector according to claim 5, wherein said second tubular portion (26) comprises two sections with different inner diameters and two O-ring joints (30) to ensure water tightness are disposed between the cable terminal (6) and said two different diameter sections.

* * * * *